US008161682B2

(12) United States Patent
Marocco

(10) Patent No.: US 8,161,682 B2
(45) Date of Patent: Apr. 24, 2012

(54) SHUTTER WITH SIDE PULL BAR

(76) Inventor: Mario M. Marocco, Woodbridge (CA)

( * ) Notice: Subject to any disclaimer, the term of this patent is extended or adjusted under 35 U.S.C. 154(b) by 286 days.

(21) Appl. No.: 12/461,711

(22) Filed: Aug. 21, 2009

(65) Prior Publication Data

US 2011/0041440 A1 Feb. 24, 2011

(51) Int. Cl.
*E06B 7/086* (2006.01)

(52) U.S. Cl. ..... 49/87.1; 49/74.1

(58) Field of Classification Search ..... 49/74.1, 49/82.1, 87.1, 90.1, 403, 73.1, 92.1; 160/236
See application file for complete search history.

(56) References Cited

U.S. PATENT DOCUMENTS 5,490,353 A * 2/1996 McLaughlin ..... 49/64
5,778,598 A * 7/1998 Ohanesian ..... 49/74.1
5,921,028 A * 7/1999 Marocco ..... 49/403
6,041,547 A 3/2000 Marocco
6,401,395 B2 * 6/2002 Gabriele ..... 49/403
6,418,665 B1 * 7/2002 Gabriele ..... 49/87.1
6,510,655 B1 * 1/2003 Antonini ..... 49/87.1
6,655,091 B1 * 12/2003 Iwasaki ..... 49/403
6,865,847 B2 * 3/2005 Fraser et al. ..... 49/90.1
6,901,701 B2 * 6/2005 Lee ..... 49/82.1
7,353,636 B1 * 4/2008 Anderson et al. ..... 49/82.1
7,363,748 B2 * 4/2008 Gabriele ..... 49/403
7,377,074 B2 * 5/2008 Marocco ..... 49/87.1

* cited by examiner

*Primary Examiner* — Katherine W Mitchell
*Assistant Examiner* — Justin Rephann

(57) ABSTRACT

A shutter having a rectangular frame, and louvres, and with a side pull bar located along one edge of the frame and connected to the adjacent ends of the louvres, the louvres being pivotally mounted in the frame in parallel relation to one another, and being rotatable between open and closed positions, and having a pull bar having a plurality of hinge assemblies, a hinge sleeve member at one end on each louvre, each respective hinge assemblies being engaged with a respective sleeve member, and an anti rotation formation on each sleeve member engaging the interior of its respective louvre so as to retain said sleeve member in its respective louvre.

10 Claims, 4 Drawing Sheets

SHUTTER WITH SIDE PULL BAR

FIELD OF THE INVENTION

The invention relates to shutters having frames, with louvres supported in the frame and being rotatable between open and closed positions, and in particular to shutters having pull bars to control the louvres, in which the pull bar is located to one end of the louvres, alongside the shutter frame.

BACKGROUND OF THE INVENTION

Shutters having a frame and louvres extending across the frame are well know. The louvres can rotate between open and closed positions. Pull bars have been used for this purpose for many years. Usually the pull bar is located midway between the two ends of the louvres.

It is considered by some to be more desirable to locate the pull bar adjacent to one end of the louvres, alongside the shutter frame. Examples of this arrangement can be seen in prior patents. U.S. Pat. No. 6,041,547 is one example of this arrangement. This arrangement was particularly suitable for use with louvres which were made of hollow thermoplastic material. The design shown in this patent used end closures for the hollow louvres, and small pivot holes were formed in the end closures. Connectors were provided for connection between the pull rod and the end closures. These connectors had slender pins, which pins were received in the pin holes in the end closures.

This arrangement worked satisfactorily, provided the consumer was careful in operating the pull rod. If the pull rod was subjected to a more violent movement than was necessary, the pins could be broken off.

It is of course desirable make such products so that they will stand up to extended use, and to some degree of misuse, as well.

BRIEF SUMMARY OF THE INVENTION

With a view to providing a shutter having a frame, and louvres, and with a side pull bar connected to the ends of the louvres, which is more rugged and durable, the invention comprises, a shutter having a rectangular frame, and louvres pivotally mounted in the frame in parallel relation to one another, and being rotatable between open and closed positions, and a sleeve member at one end of each of said louvres, and a pull bar having a plurality of drive pins, each drive pin being received in a respective sleeve member, and an anti rotation formation on each said sleeve member engaging the interior of its respective louvre whereby to retain said sleeve member in its respective said louvre and to prevent rotation of said sleeve member in its respective louvre In one preferred embodiment the louvres are formed of hollow plastic, typically vinyl plastic, extruded with an aerofoil shape, and having two end closures formed with integral axle pins. The axle pins extend outwardly, into axle openings in opposed sides of said frame.

Preferably in this embodiment the end closure at one end of each louvre is incomplete and leaves a space for insertion of the sleeve member into said louvre.

In another embodiment the louvres may be made of solid wood. In this case since the louvres are solid, there are no end closures. The louvres are drilled at one end, and the sleeves are inserted in respective drillings.

The pull rod is preferably formed as a generally channel shaped extrusion, and an outer sheath slides over the extrusion.

The pull rod has a plurality of pivot arms, each having a drive pin integral therewith for reception in respective a said sleeve, and a mounting plate formed at right angles to said pivot arm and a connection plug formed on said mounting plate, the connection plug being frictionally retained in said channel shape of said pull bar.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
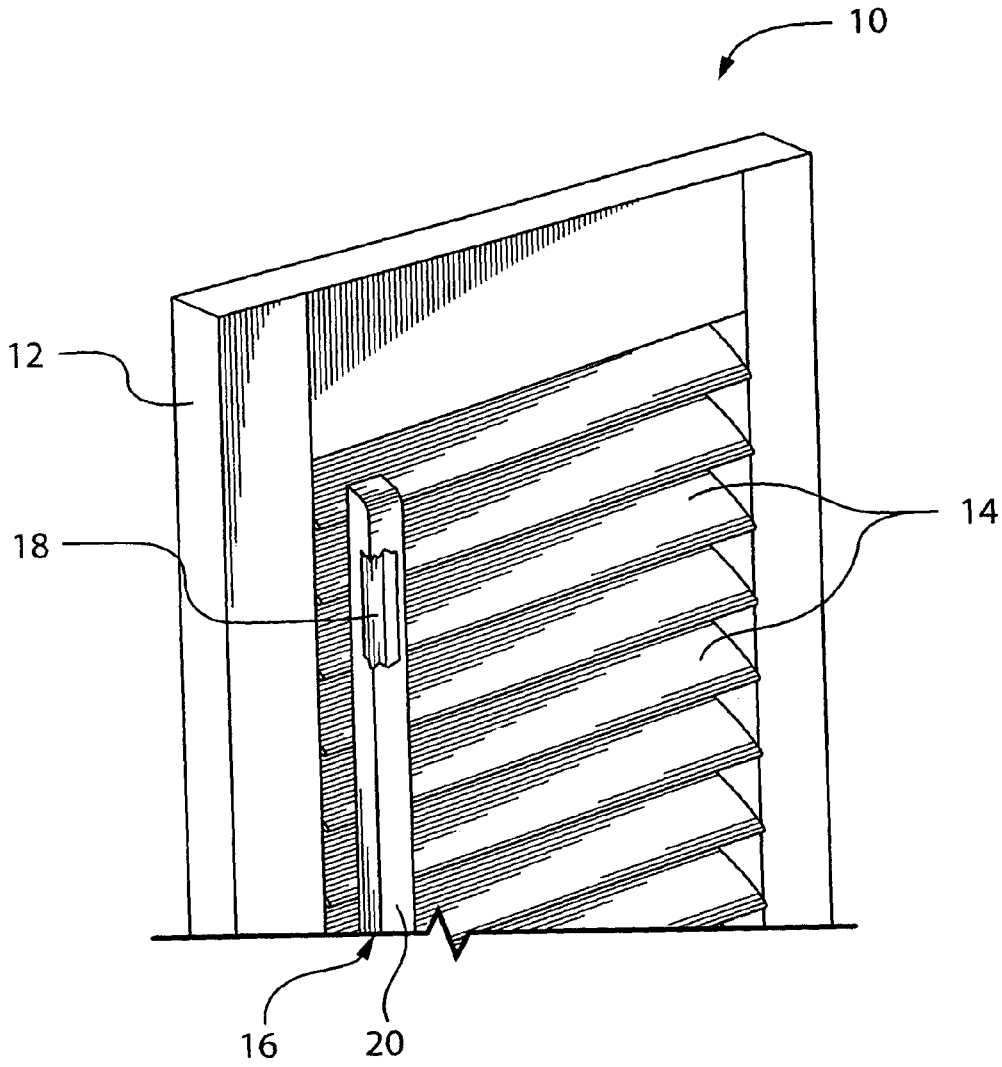
FIG. 1 is a general perspective of a portion of a shutter illustrating the side pull bar.

As shown generally in FIG. 1, the invention is illustrated in the form a shutter (10), having a frame (12) and louvres (14). The louvres (14) are horizontal and extend from side to side of the frame. The louvres are pivoted in the opposite side of the frame by suitable pivots to be described below.

In order to swing all the louvres simultaneously, either open or closed, and also to hold them in a desired position, an side pull bar (16) is provided. The location of the side pull bar to one side of the frame, at the ends of the louvres is considered desirable by many consumers, since it leaves the view through the louvres, when open, unobstructed.

The side pull bar (16) consists, of an inner bar member (18), covered by an outer sleeve (20). The inner bar member (18) is in the form of an extruded member with a recessed channel (22).

Figure 2:
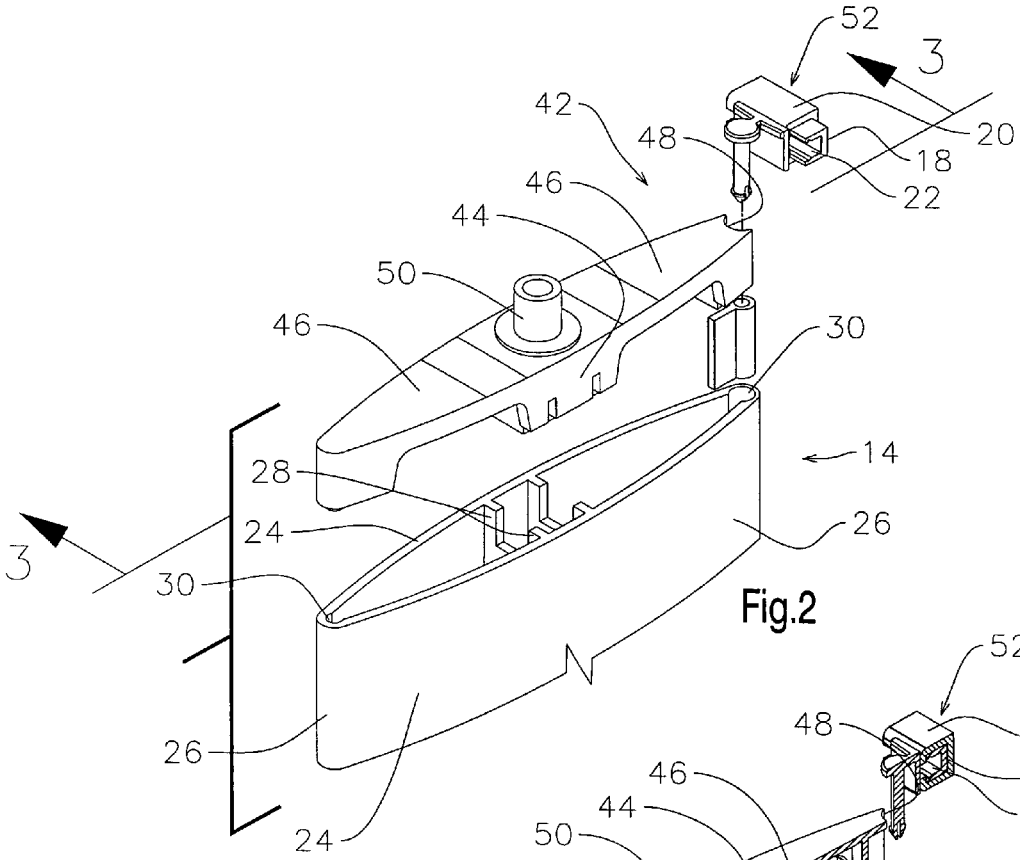
FIG. 2 is an exploded perspective illustration of a first embodiment of the invention, for use with a first end of the hollow plastic louvres.
Figure 3:
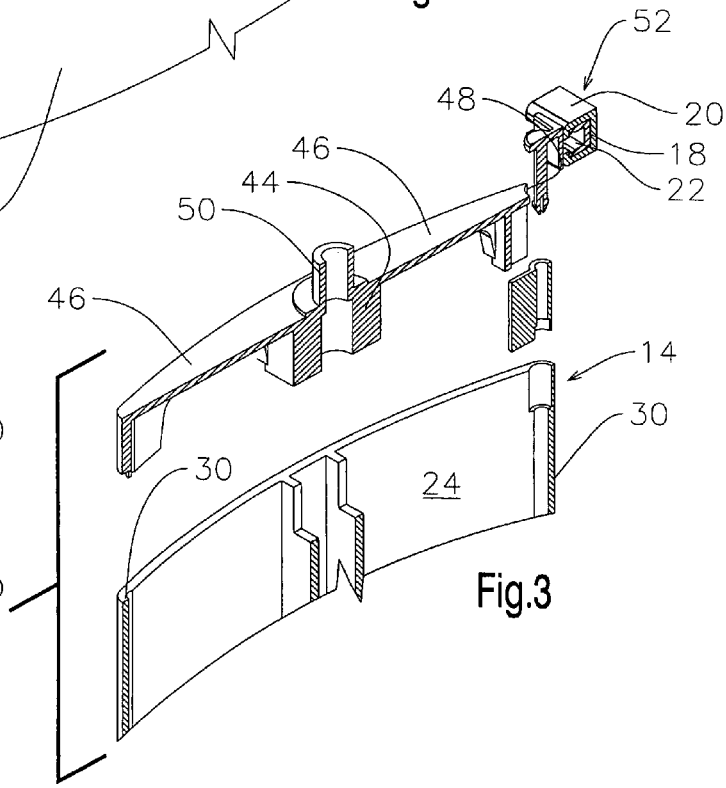
FIG. 3 is a view corresponding to FIG. 2, partially cut away along line 3 3 of FIG. 2.
Figure 4:
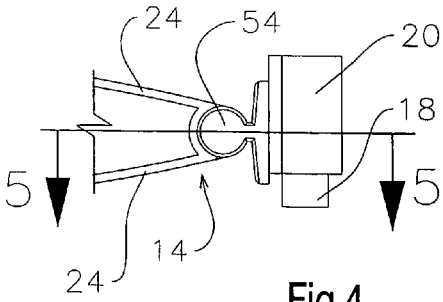
FIG. 4 is a side elevation of the pull bar connectors
Figure 5:
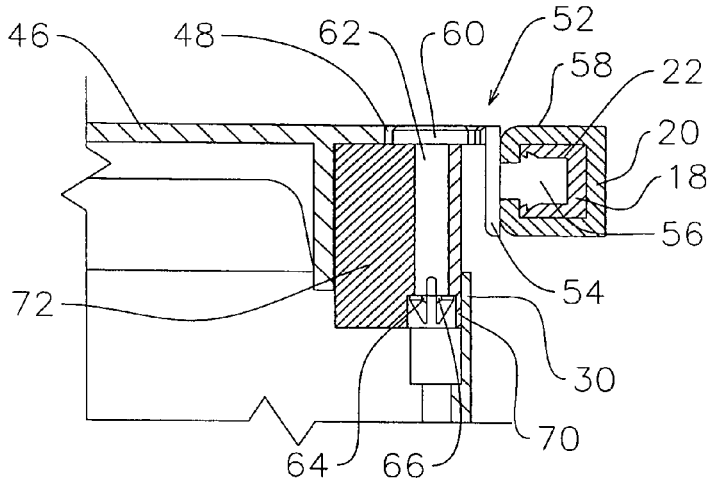
FIG. 5 is a section along 5-5 of FIG. 4.
Figure 7:
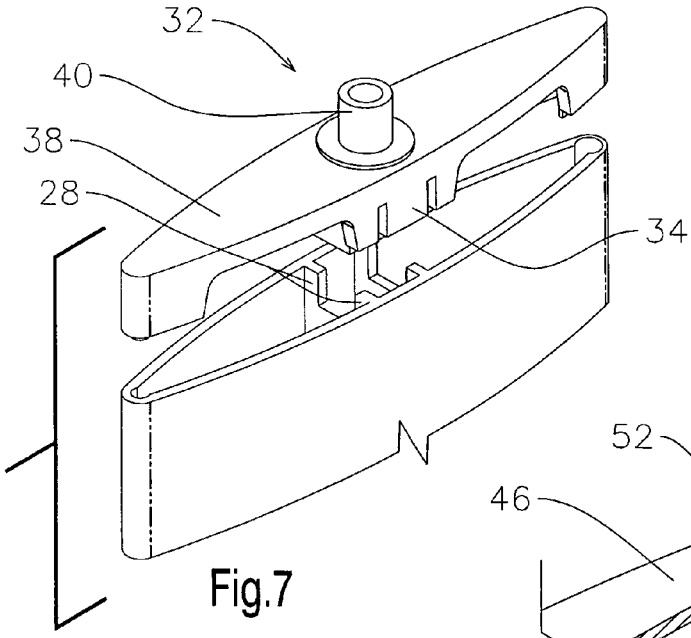
FIG. 7 is an exploded view of a second end of the louvres.
Figure 6:
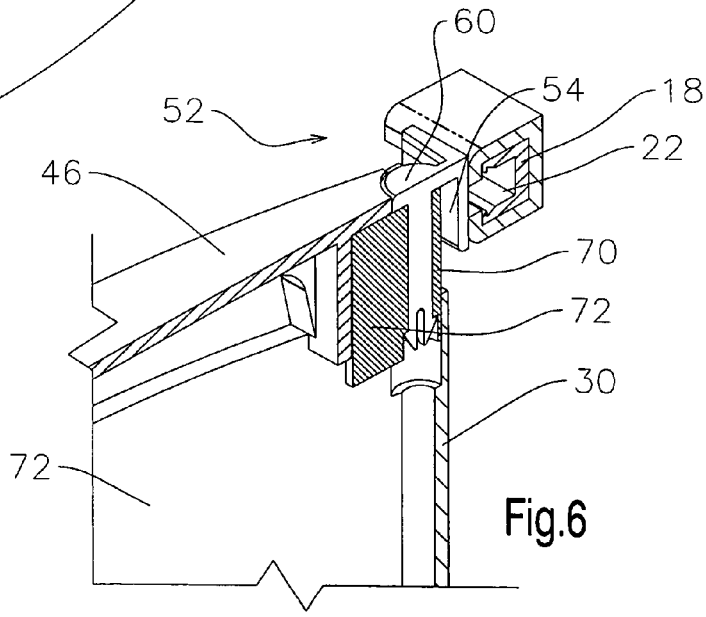
FIG. 6 is a perspective of the pull bar connector, with an end portion of a hollow louvre partially cut away.
Figure 8:
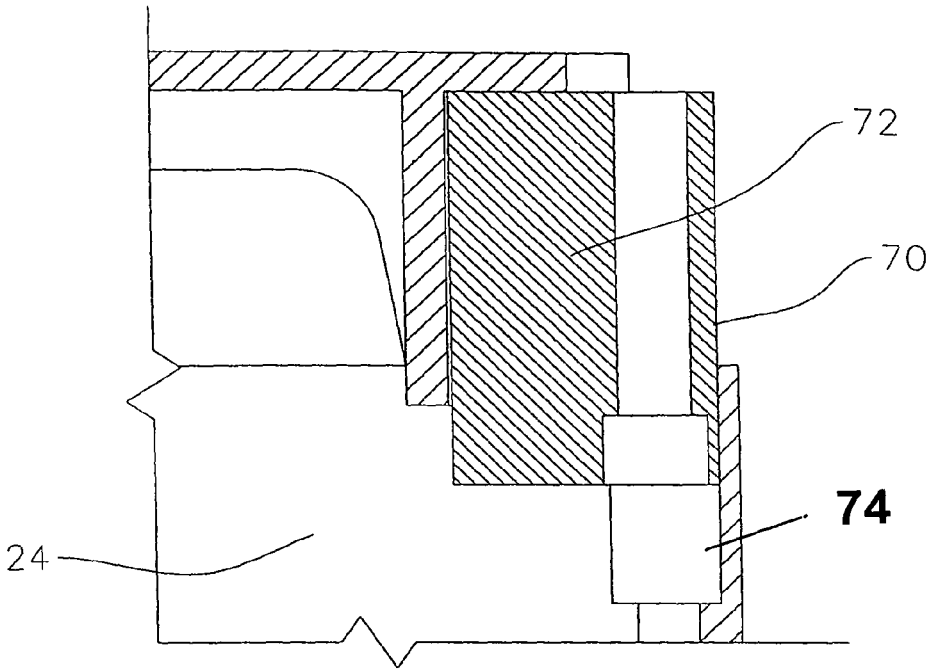
FIG. 8 is a section along 8-8 of FIG. 6.

Referring to FIGS. 2, 3 and 7 it will be seen that in one embodiment the louvres are made of thermoplastic in a hollow extrusion, forming two louvre walls (24) defining a generally aerofoil shape, the walls meeting at edges (26). Within the louvre walls there are formed reinforcing walls (28) formed parallel side by side, from end to end.

At the edges (26) semi annular surfaces (30) are formed, from end to end, for extra strength.

At one end of each louvre (14) (FIG. 7) there is an end closure (32), consisting of a central body (34) fitting with reinforcing walls (36).

Closure arms (38) extend from either side of body (34), to close of the open end of the louvre.

A stub pivot (40) is formed on body (34) extending outwardly, to act as a pivot for that end of the louvre.

At the other end of each louvre there is a end member (42), which is generally similar to end closure (32).

End member (42) has a central body (44), interfitting with reinforcing walls (28) within the louvre, which may be cut away for the purpose (FIG. 3).

End member (42) has arms (46) closing off the end of the louvre. The end of one arm (46) is shorter than the other as at (48) for reasons to be described below.

A stub pivot (50) extends out from central body (44) to act as a pivot for this end of the louvre.

In order to move and control all the louvres simultaneously, each louvre has a hinge connector assembly shown generally as (52).

The hinge connector assembly (52) consists in this embodiment, of a main body (54), of generally flat, planar shape. A capture pin (56) extends from main body (54) and is adapted to make a frictional fit in channel (22) of inner bar member (18). Pin (56) is of tapering wedge shape, so as to facilitate insertion into the channel (22). Retention shoulders (58) make a snap fit in channel (22) so that it cannot become loose.

A side flange (60) extends from main body (54), normal thereto. Flange (60) has a hinge pin (62), extending therefrom normal thereto. Pin (62) has an enlarged head (64), and has a central split (66) for reasons described below.

For each louvre (14) there is a hinge sleeve (70) formed as a cylindrical tube. Sleeve (70) has an anti rotation formation, in this case a wing plate (72) extending therefrom to one side. The semi annular surfaces (30) adjacent one end of the louvre (14) have a recess (74) formed axially therein. Hinge sleeve (70) makes a snug friction fit in recess (74).

The hinge pin (62) can be forced into hinge sleeve (70), with the head (64) being squeezed together. Once through the sleeve (70) the head will expand and capture the hinge pin (62) in the hinge sleeve (70).

In this way each hinge pin and hinge sleeve for a hinge joint, connecting the inner bar member (18) to each respective louvre (14) at spaced intervals.

It will be apparent that when the side pull bar (16) is moved, it will move all louvres (14) simultaneously, to swing them either closed or open.

The friction inherent in the hinge pins and sleeves will usually be sufficient to hold the louvres in a present position.

In some cases however a friction brake can be incorporated in one of the stub pivots of one louvre (14) (not shown). Such friction brake systems are well known and require no special description.

Figure 9:
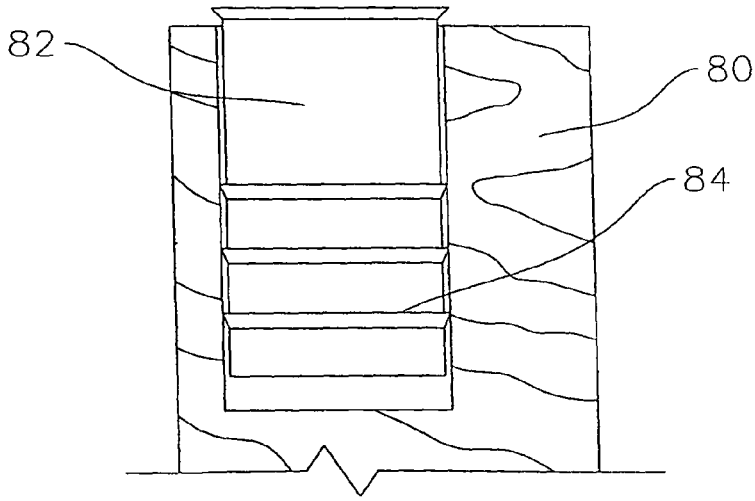
FIG. 9 is a section of a louvre formed of wood , and, illustrating an alternate embodiment of sleeve member.

In some cases the louvres (80) can be formed of solid wood (FIG. 9). In this case since the louvre is not hollow, the sleeve member (82) is used. Anti rotation formations (84) are formed as annular rings, around the exterior of sleeve (82).

The louvre is drilled at one edge to receive it.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A shutter having a rectangular frame, and louvres, and a side pull bar located along one edge of the frame and connected to the adjacent ends of the louvres, the louvres being pivotally mounted in the frame in parallel relation to one another, and being rotatable between open and closed positions, and comprising;

a recess at one end of each said louvre;

a pull bar having a plurality of hinge assemblies;

a plurality of hinge sleeve members separate from said louvres, there being one said hinge sleeve member located in a respective said recess one end of each said louvre, each of said respective hinge assemblies being engaged with a respective hinge sleeve member, and an anti rotation formation on each said hinge sleeve member engaging the interior of its respective louvre whereby to retain said hinge sleeve member in its respective said louvre and to prevent rotation of said hinge sleeve member in its respective louvre.

2. A shutter having a rectangular frame, and louvres, as claimed in claim 1 wherein said louvres are formed of hollow plastic, extruded with an aerofoil shape, and having end closures at one end of each said louvre and end members at the other end of each said louvre, said end closures and said end members having integral stub axle pins and extending into opposed sides of said frame.

3. A shutter having a rectangular frame, and louvres as claimed in claim 2, and wherein said end member at one end of each louvre defines a space and wherein said hinge sleeve member is located in said space.

4. A shutter having a rectangular frame, and louvres as claimed in claim 3 and including reinforcing walls formed within said hollow louvres, and including a body formation on said end closures and on said end members, interfitting with said walls.

5. A shutter having a rectangular frame, and louvres as claimed in claim 4 and including edge formations formed along opposed edges of each said louvre, said edge formations defining interior semi-annular surfaces.

6. A shutter having a rectangular frame, and louvres as claimed in claim 5 wherein said pull rod comprises a generally channel shaped extrusion, and including outer sheath fitted over said extrusion.

7. A shutter having a rectangular frame, and louvres as claimed in claim 6 wherein each said hinge assembly includes a main body, a captive pin engaged within said channel shaped extrusion, a side flange, and a hinge pin on said side flange, engaged in said hinge sleeve member.

8. A shutter having a rectangular frame, and louvres as claimed in claim 1 wherein said anti rotation formation is a wall extending to one side of said hinge sleeve member.

9. A shutter having a rectangular frame, and louvres as claimed in claim 1 and wherein said louvres are made of solid wood, and wherein said louvres have drillings at one end, and including respective hinge sleeve members inserted in respective drillings.

10. A shutter having a rectangular frame, and louvres as claimed in claim 9 wherein said anti rotation formation is an annular friction formation on the exterior of said hinge sleeve member.

* * * * *